US006338605B1

(12) United States Patent
Halverson et al.

(10) Patent No.: US 6,338,605 B1
(45) Date of Patent: Jan. 15, 2002

(54) TRACTOR AND SYSTEM FOR UNLOADING TRAILERS FROM RAILCARS

(75) Inventors: Merlin B. Halverson, Lawrence, KS (US); Henry Lamb, Longview, TX (US)

(73) Assignee: Kalmar Industries USA Inc., Ottawa, KS (US)

( * ) Notice: Subject to any disclaimer, the term of this patent is extended or adjusted under 35 U.S.C. 154(b) by 0 days.

(21) Appl. No.: 09/386,190

(22) Filed: Aug. 30, 1999

(51) Int. Cl.[7] ..... B65G 63/00

(52) U.S. Cl. ..... 414/333; 410/58; 293/118; 414/339; 414/920; 414/340

(58) Field of Search ..... 414/333, 340, 414/339, 812, 383, 389, 341, 343, 920; 410/58, 59, 60, 64; 280/432; 254/93 VA; 293/118, 119, DIG. 1

(56) References Cited

U.S. PATENT DOCUMENTS 3,198,551 A * 8/1965 Garner ..... 293/118 X
3,434,683 A * 3/1969 Rollins ..... 410/58
3,751,092 A * 8/1973 Granig ..... 293/118 X
5,452,982 A 9/1995 Engle ..... 414/333
5,501,566 A * 3/1996 Engle ..... 414/333
5,518,354 A 5/1996 Engle ..... 414/333

* cited by examiner

*Primary Examiner*—Frank E. Werner
(74) *Attorney, Agent, or Firm*—Daniel J. Chalker; Sanford E. Warren, Jr.; Gardere Wynne Sewell LLP

(57) ABSTRACT

A tractor (20) for unloading a trailer (12) from a railcar (14) is disclosed. The tractor (20) comprises a trigger actuator (34) and a bumper (30). The trigger actuator (34) is fixably mounted to the tractor (20) and remains stationary. The bumper (30) of the tractor (20) may be operated between an extended position and a retracted position. When the bumper (30) is in the extended position and the tractor (20) is adjacent to a stanchion (16), the trigger actuator (34) does not engage the trigger of the stanchion (16). When the bumper (30) is in the retracted position and the tractor (20) is adjacent to the stanchion (16), the trigger actuator (34) engages the trigger (28) of the stanchion (16) to operate the stanchion (16) from the raised position to the lowered position, thereby transferring the trailer (12) from the stanchion (16) to the tractor (20).

12 Claims, 2 Drawing Sheets

TRACTOR AND SYSTEM FOR UNLOADING TRAILERS FROM RAILCARS

TECHNICAL FIELD OF THE INVENTION

This invention relates in general to the transportation of truck trailers on flat bed railcars and, in particular to, a tractor and system for unloading truck trailers from railcars that prevents inadvertent knockdown of the stanchion that supports the trailer on the railcar during transportation thereof.

BACKGROUND OF THE INVENTION

Without limiting the scope of the present invention, its background is described with reference to transporting trailers on flat bed railcars, as an example.

It is well known in the art of truck trailer transportation over the railroad system, that the trailers must be loaded and secured to railcars. The process typically involves backing a tractor that is attached to the trailer onto the railcar until the trailer reaches the desired location. Once in this position, a hook from the tractor may be engaged with a stanchion on the railcar that will be used to support the trailer during transportation on the railcar. Once the hook is engaged with the stanchion, the driver may set the trailer brakes, disengage the tractor from the kingpin of the trailer and pull slowly forward.

Now, as the tractor is moving forward, the trailer remains stationary. Thus, as the tractor moves forward, the tractor's fifth wheel moves toward the front of the trailer, making room for the top plate of the stanchion. As the driver continues to move forward, the vertical strut of the stanchion is pulled to the upright position. When the vertical strut is erect and locked, a release trigger on the stanchion is placed in its fully extended position. With the stanchion properly erected under the trailer, the driver lowers the tractor's fifth wheel thereby lowering the trailer onto the top plate of the stanchion.

Next, the driver disengages the hook from the stanchion and pulls forward to a point where the tractor's fifth wheel is partially out from under the trailer's threshold plate. The driver then raises the fifth wheel to a position above the level of the trailer threshold plate, releases the trailer brakes and pushes the trailer back until the trailer's kingpin engages the stanchion's top plate which ties the trailer to the stanchion and secures the trailer to the railcar. The driver may then exhaust the brake hoses, disconnect the hoses from the trailer and drive off the deck of the railcar. The trailer may now be transported on the railcar over the rail system.

Once the trailer arrives at its intended location, the trailer must now be removed from the railcar. To achieve this, the driver backs the tractor onto the railcar and under the front of the selected trailer with the tractor's fifth wheel in its lowest position. The driver then raises the fifth wheel into contact with the threshold plate under the trailer and connects the trailer air brake hoses. The driver then applies the trailer brakes and backs the tractor against the release trigger of the stanchion. This causes the release trigger to depress and in turn release the top plate of the stanchion from the kingpin allowing the vertical strut of the stanchion to fold down. With the stanchion out of the way and the full weight of the trailer transferred to the tractor, the driver backs further to couple the fifth wheel of the tractor with the trailer's kingpin and tests the coupling by applying forward motion against the still applied trailer brakes. The driver may then release the trailer brakes and remove the trailer from the railcar.

It has been found, however, that with conventional tractors, when the driver backs the tractor on the railcar toward the stanchion, the release trigger of the stanchion may be inadvertently contacted by the trigger actuator of the tractor causing the premature release of the top plate of the stanchion from the kingpin and prematurely allowing the vertical strut of the stanchion to fold down. Attempts have been made to overcome this problem, such as that described in U.S. Pat. No. 5,452,982. The system described therein, however, requires the driver of the tractor to back up into the stanchion until the bumper of the tractor contacts the stanchion, move the tractor forward to provide clearance between the tractor and the stanchion, operate the trigger actuator from a retracted position to an extended position and then back the tractor up again such that the trigger actuator of the tractor will engage the trigger of the stanchion, thereby allowing the vertical strut of the stanchion to fold down.

Therefore, a need has arisen for a tractor and system that avoids inadvertent contact between the trigger actuator of the tractor and the trigger of the stanchion to avoid premature fold down of the vertical strut of the stanchion. A need has also arisen for such a tractor and system that does not require complicated tractor maneuvering including multiple steps of moving the tractor backward and forward to knock down the stanchion to avoid the inadvertent contact between the trigger actuator of the tractor and the trigger of the stanchion.

SUMMARY OF THE INVENTION

The present invention disclosed herein provides a tractor and system for removing a trailer from a railcar that avoids inadvertent contact between the trigger actuator of the tractor and the trigger of the stanchion, which prevents premature fold down of the vertical strut of the stanchion. The tractor and system of the present invention achieve this result without requiring complicated tractor maneuvering such as multiple steps of moving the tractor backward and forward to knock down the stanchion.

The tractor of the present invention comprises a trigger actuator and a bumper that interact with the stanchion on the railcar. The trigger actuator is fixed to the frame of the tractor in a single position such that it may selectively interact with the trigger of the stanchion to knock down the stanchion and allow coupling of the trailer with the tractor. The trigger actuator selectively interacts with the trigger of the stanchion based upon the position of the bumper. Specifically, when the bumper is in the extended position and the tractor is adjacent to the stanchion, the trigger actuator does not engage the trigger of the stanchion. Conversely, when the bumper is in the retracted position and the tractor is adjacent to the stanchion, the trigger actuator may engage the trigger of the stanchion.

To prevent interaction between the trigger actuator of the tractor and the trigger of the stanchion when the bumper is in the extended position, the bumper extends to a point beyond the trigger actuator. To allow interaction between the trigger actuator of the tractor and the trigger of the stanchion when the bumper is in the retracted position, the bumper may be retracted to a point at or behind the trigger actuator.

The system of the present invention comprises a stanchion on the railcar that has raised and lowered positions. The stanchion includes a lock for locking the stanchion in the raised position and a trigger for unlocking the lock. The system also comprises a tractor having a trigger actuator fixably mounted thereto for engaging the trigger of the stanchion and a bumper for selectively allowing and preventing the trigger actuator from engaging the trigger. The trigger actuator is prevented from engaging the trigger when the bumper is in its extended position as the bumper comes in contact with the stanchion before the trigger actuator comes in contact the trigger. To allow engagement of the trigger actuator with the trigger, however, the bumper is operated to the retracted position such that the trigger actuator will contact the trigger before the bumper contacts the stanchion, thereby unlocking the lock and allowing the stanchion to fold down.

The method of the present invention involves positioning the tractor on the railcar, backing the tractor toward the stanchion until the bumper contacts the stanchion without engaging the trigger actuator of the tractor with the trigger of the stanchion, operating the bumper from the extended position to the retracted position and backing the tractor toward the stanchion to engage the trigger actuator of the tractor with the trigger of the stanchion, thereby unlocking the stanchion and operating the stanchion to its lowered position.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
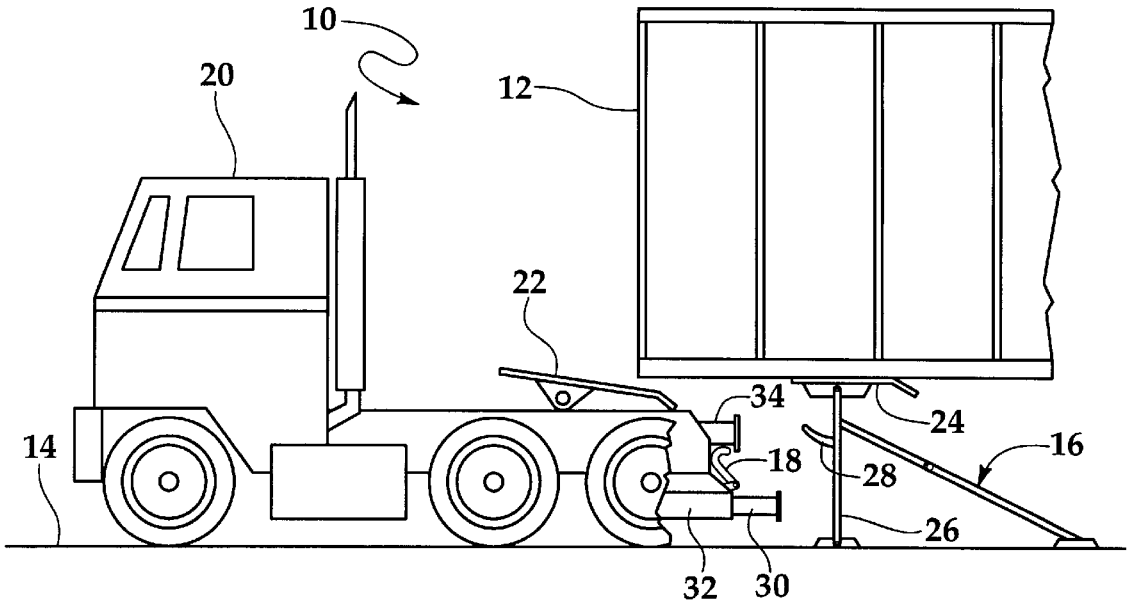
FIG. 1 is a side elevation view of a tractor of the present invention backing up to a trailer supported by a stanchion on a railcar.

Referring to FIG. 1, a tractor backing up to a trailer supported by a stanchion on a flat bed railcar is schematically depicted and generally designated 10. As explained above, a trailer 12 may be transported over the railroad system by securing trailer 12 to a railcar 14 (only the surface of which is depicted). Trailer 12 is initially attached to railcar 14 by operating a stanchion 16 from the lowered position to the raised position using a hook 18 of a tractor 20 as is well known in the art. Once stanchion 16 is in its raised position, the driver of tractor 20 may set the trailer brakes, disengage tractor 20 from the kingpin (not pictured) of trailer 12 and pull slowly forward.

As the fifth wheel 22 of tractor 20 moves forward, the top plate or fifth wheel 24 of stanchion 16 couples with the kingpin of trailer 12. As the driver continues to move forward, the vertical strut 26 of stanchion 16 is pulled to the upright position. When vertical strut 16 is erect and locked, a release trigger 28 of stanchion 16 is placed in its fully extended position placing stanchion 16 in the position depicted in FIG. 1.

To unload trailer 12 from railcar 14, tractor 20 is backed up onto railcar 14 until tractor 20 is under trailer 12. A pair of positively controlled bumpers 30, only one of which is shown, extend rearwardly from tractor 20 and are operable between an extended position and a retracted position. A fluid motor 32 controls the position of bumpers 30. Tractor 20 also has a trigger actuator 34 that is fixably mounted to the tractor frame in a single position. Trigger actuator 34 selectively engages and actuates trigger 28 on vertical strut 26 of stanchion 16.

Figure 2:
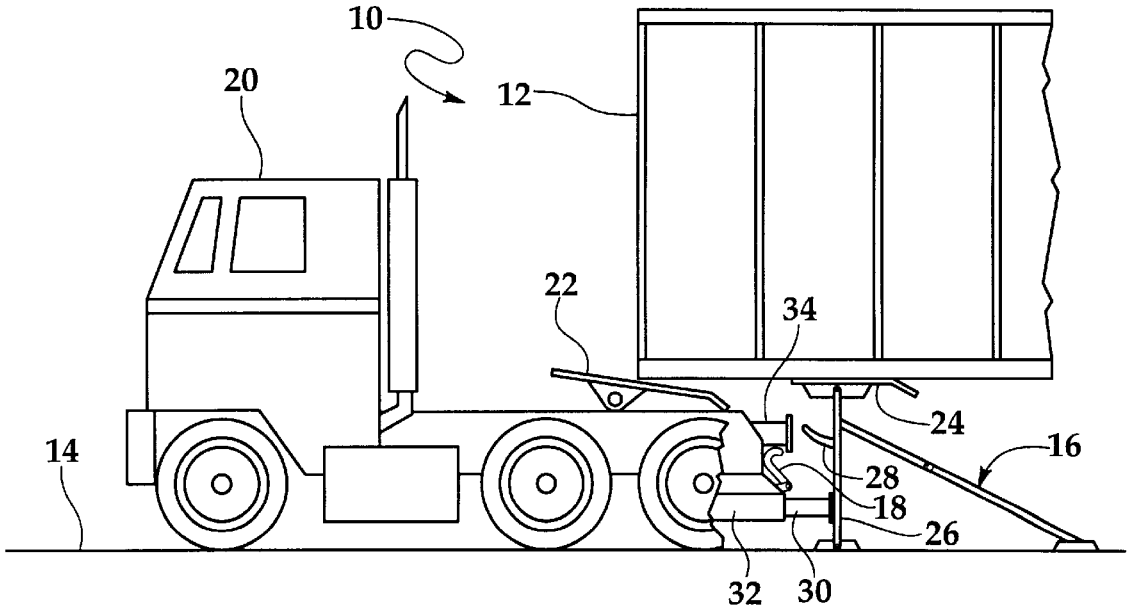
FIG. 2 is a side elevation view of a tractor of the present invention with the bumpers thereof in contact with a stanchion supporting a trailer on a railcar.

As best seen in FIG. 2, the bumpers 30 are initially extended beyond the trigger actuator 34 such that when tractor 20 is backed up to stanchion 16, bumpers 30 engage vertical strut 26 before trigger actuator 34 comes in contact with trigger 28 of stanchion 16. As trigger actuator 34 is fixed to the frame of tractor 20, trigger actuator 34 may be selectively prevented from engaging trigger 28 based upon the position of bumpers 30. Specifically, when bumpers 30 are in the extended position and tractor 20 is adjacent to stanchion 16, trigger actuator 34 does not engage trigger 28 of stanchion 16. To prevent such interaction between trigger actuator 34 of tractor 20 and trigger 28 of stanchion 16 when tractor 20 is backing up, bumpers 30 extend to a point beyond trigger actuator 34 to ensure that bumpers 30 contact vertical strut 26 of stanchion 16 before trigger actuator 34 of tractor 20 contacts trigger 28 of stanchion 16.

Figure 3:
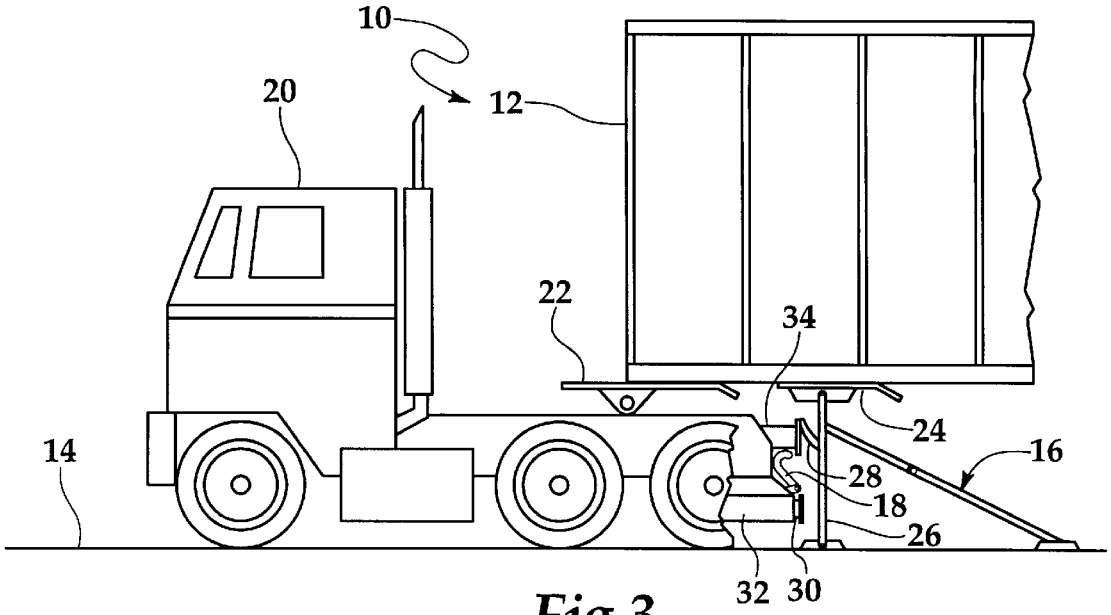
FIG. 3 is a side elevation view of a tractor of the present invention with the bumper in the retracted position and the trigger actuator in contact with the trigger of a stanchion that is supporting a trailer on a railcar.

As depicted in FIG. 3, the driver may now operate bumpers 30 from the extended position to the retracted position using fluid motor 32. Once bumpers 30 are operated from the extended position to the retracted position, trigger actuator 34 is in a position at or beyond bumpers 30. In this configuration of bumpers 30 and as tractor 20 backs up, trigger actuator 34 of tractor 20 will contact trigger 28 of stanchion 16 before bumpers 30 engage vertical strut 26. With further backward movement of tractor 20, trigger actuator 34 depresses trigger 28 to unlock stanchion 16, strut 26 and fifth wheel 24 such that stanchion 16 can collapse when engaged by bumpers 30.

Figure 4:
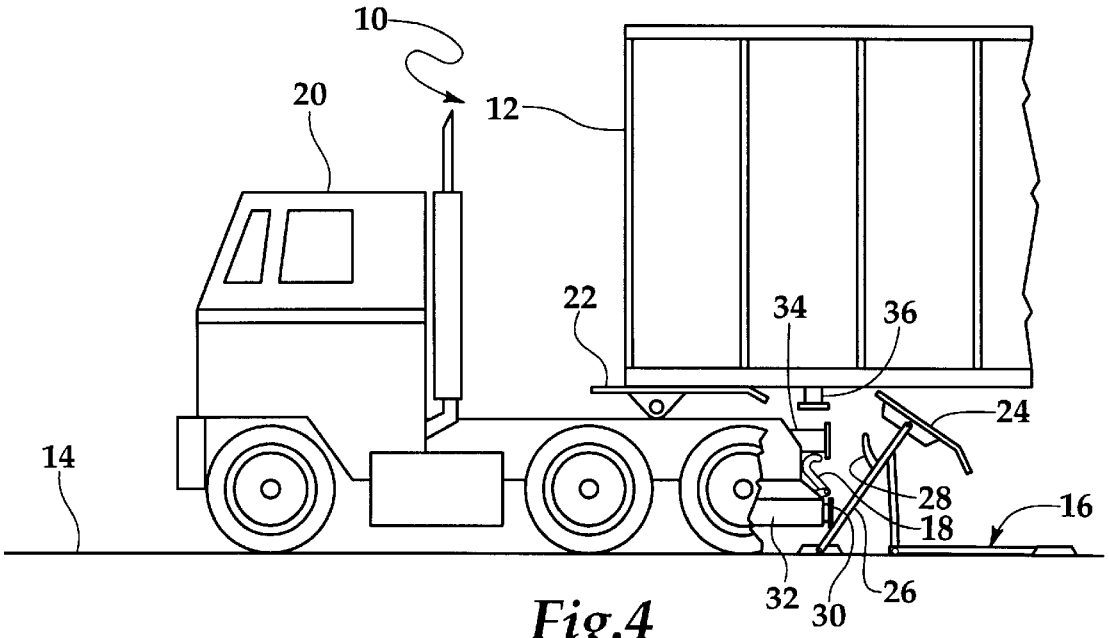
FIG. 4 is a side elevation view of a tractor of the present invention coupled to a trailer after knocking down a stanchion on a railcar.

As best seen in FIG. 4, with continued backward movement of tractor 20 stanchion 16 collapses with the weight of trailer 12 shifting from fifth wheel 24 of stanchion 16 to fifth wheel 22 of tractor 20. Thereafter, additional backward movement of tractor 20 causes the trailer king pin 36 to couple with fifth wheel 22 of tractor 20. The driver may now connect the brake hoses of tractor 20 to trailer 12 and releases the trailer brakes to allow removal of trailer 12 from railcar 14.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tractor for unloading a trailer from a railcar that is supported by a locked stanchion having a trigger, the tractor comprising:

a trigger actuator fixably mounted to the tractor;

at least one bumper on the tractor having an extended position and a retracted position, when the at least one bumper is in the extended position the at least one bumper prevents the trigger actuator from engaging the trigger when the tractor moves towards the locked stanchion, and when the at least one bumper is in the retracted position the at least one bumper permits the trigger actuator to engage the trigger and unlock the stanchion when the tractor moves adjacent the stanchion, thereby allowing the weight of the trailer to collapse the stanchion, which shifts the weight of the trailer from the stanchion to the tractor; and a motor coupled to the at least one bumper to operate the at least one bumper between the extended position and the retracted position.

2. The tractor as recited in claim 1 wherein the at least one bumper further comprises a pair of bumpers.

3. The tractor as recited in claim 1 further comprising a fluid motor operably coupled to the at least one bumper to operate the at least one bumper between the extended position and the retracted position.

4. The tractor as recited in claim 1 wherein the at least one bumper extends beyond the trigger actuator when the at least one bumper is in the extended position.

5. The tractor as recited in claim 1 wherein the trigger actuator extends beyond the at least one bumper when the one bumper is in the retracted position.

6. The tractor as recited in claim 1 wherein the trigger actuator and the at least one bumper extend generally to the same position behind the tractor when the at least one bumper is in the retracted position.

7. A system for supporting and unloading a trailer from a railcar with a tractor comprising:

a stanchion on the railcar having raised and lowered positions, the stanchion including a lock for locking the stanchion in the raised position and a trigger for unlocking the lock, thereby allowing the weight of the trailer to collapse the stanchion, which shifts the weight of the trailer from the stanchion to the tractor;

a trigger actuator fixably mounted to the tractor for engaging the trigger of the stanchion;

at least one bumper on the tractor, the at least one bumper having an extended position and a retracted position, the at least one bumper contacting the stanchion before the trigger actuator engages the trigger when the at least one bumper is in the extended position and the tractor moves adjacent to the stanchion, the trigger actuator engaging the trigger before the at least one bumper contacts the stanchion when the at least one bumper is in the retracted position and the tractor moves adjacent to the stanchion; and a motor coupled to the at least one bumper to operate the at least one bumper between the extended position and the retracted position.

8. The system as recited in claim 7 wherein the at least one bumper further comprises a pair of bumpers.

9. The system as recited in claim 7 further comprising a fluid motor operably coupled to the at least one bumper to operate the at least one bumper between the extended position and the retracted position.

10. The system as recited in claim 7 wherein the at least one bumper extends beyond the trigger actuator when the at least one bumper is in the extended position.

11. The system as recited in claim 7 wherein the trigger actuator extends beyond the at least one bumper when the at least one bumper is in the retracted position.

12. The system as recited in claim 7 wherein the trigger actuator and the at least one bumper extend generally to the same position behind the tractor when the at least one bumper is in the retracted position.

* * * * *